US010548361B1

(12) United States Patent
Suttman et al.

(10) Patent No.: US 10,548,361 B1
(45) Date of Patent: Feb. 4, 2020

(54) TECHNOLOGY BACKPACK

(71) Applicant: Vaprwear Gear LLC, Englewood, CO (US)

(72) Inventors: Steven Suttman, Castle Pines, CO (US); Tom Gruger, Greenwood Village, CO (US); Marietta Cantu, Aurora, CO (US)

(73) Assignee: VAPRWEAR GEAR LLC, Denver, CO (US)

( * ) Notice: Subject to any disclaimer, the term of this patent is extended or adjusted under 35 U.S.C. 154(b) by 114 days.

(21) Appl. No.: 15/681,239

(22) Filed: Aug. 18, 2017

Related U.S. Application Data

(63) Continuation-in-part of application No. 15/005,899, filed on Jan. 25, 2016, now Pat. No. 10,034,503,
(Continued)

(51) Int. Cl.
*A45F 3/16* (2006.01)
*A41D 27/20* (2006.01)
(Continued)

(52) U.S. Cl.
CPC ..... *A41D 27/20* (2013.01); *A24F 3/00* (2013.01); *A24F 47/004* (2013.01); *A41D 1/002* (2013.01);
(Continued)

(58) Field of Classification Search
CPC ... A42B 3/048; A45F 3/04; A45F 3/16; B67D 2210/00131
See application file for complete search history.

(56) References Cited

U.S. PATENT DOCUMENTS 1,900,129 A 3/1933 Ring
2,078,844 A 4/1937 Gardian
(Continued)

FOREIGN PATENT DOCUMENTS

CN 106714600 5/2017
EP 3169172 A2 5/2017
(Continued)

OTHER PUBLICATIONS

Partial supplementary European search report and provisional opinion for EP Application No. 15821812.5 dated Jan. 12, 2018, 14 pages.
(Continued)

*Primary Examiner* — Tajash D Patel
(74) *Attorney, Agent, or Firm* — Stanley J. Gradisar Attorney At Law, LLC; Stanley J. Gradisar

(57) ABSTRACT

A technology bag allows its carrier to indulge in vaping or drinking inconspicuously, or deliver a burst of vapor externally, as in pepper spray for personal protection or scenting as used in hunting. The technology bag comprises various technology compartments for various technology components including technology tanks, bladders, tubes, and other associated attachments. The technology bag can also provide a safety releasable coupling such that the various technology will "break-away" easily if snagged or caught. In one embodiment the technology bag is a backpack. In other embodiments the technology bag could be a messenger bag, briefcase, knapsack, purse, or any over-the-shoulder style bag employing a shoulder strap. In each of these embodiments the shoulder strap is operable to provide the various functionalities of the technology bag.

19 Claims, 12 Drawing Sheets

Related U.S. Application Data which is a continuation of application No. 14/801,451, filed on Jul. 16, 2015, now Pat. No. 9,332,796.

(60) Provisional application No. 62/376,847, filed on Aug. 18, 2016, provisional application No. 62/025,829, filed on Jul. 17, 2014.

(51) Int. Cl.

| | |
|---|---|
| ***A45F 3/20*** | (2006.01) |
| ***A24F 47/00*** | (2006.01) |
| ***A41D 1/04*** | (2006.01) |
| ***A24F 3/00*** | (2006.01) |
| ***A41D 13/00*** | (2006.01) |
| ***A41D 1/00*** | (2018.01) |
| ***A41D 1/02*** | (2006.01) |
| ***A41D 27/24*** | (2006.01) |

(52) U.S. Cl.

CPC ..... *A41D 1/02* (2013.01); *A41D 1/04* (2013.01); *A41D 13/0012* (2013.01); *A41D 27/24* (2013.01); *A45F 3/16* (2013.01); *A45F 3/20* (2013.01); *A41D 2200/20* (2013.01); *A41D 2400/46* (2013.01)

(56) References Cited

U.S. PATENT DOCUMENTS

| | | | | |
|---|---|---|---|---|
| 2,426,726 | A | 9/1947 | Combs | |
| 4,070,553 | A | 1/1978 | Hass | |
| 4,243,058 | A | 1/1981 | Gershbein | |
| 4,322,585 | A | 3/1982 | Liautaud | |
| 4,526,298 | A | 7/1985 | Boxer et al. | |
| 4,544,087 | A * | 10/1985 | Modig | A45F 3/16 224/148.2 |
| 4,589,134 | A | 5/1986 | Waldron | |
| 4,876,724 | A | 10/1989 | Suzuki | |
| 4,948,023 | A * | 8/1990 | Tripp | A45F 3/16 222/175 |
| 5,400,934 | A | 3/1995 | Ducros | |
| 5,416,310 | A | 5/1995 | Little | |
| 5,555,490 | A | 9/1996 | Carroll | |
| 5,722,573 | A | 3/1998 | Camel | |
| 5,816,457 | A | 10/1998 | Croft | |
| 5,901,889 | A * | 5/1999 | Ho | A45F 3/16 128/DIG. 26 |
| 5,940,880 | A * | 8/1999 | Phillips | A42B 3/048 2/181 |
| 6,220,490 | B1 * | 4/2001 | O'Hara | A45F 3/16 2/102 |
| 6,339,846 | B2 | 1/2002 | Uchida | |
| 6,801,140 | B2 | 10/2004 | Mantyjarvi et al. | |
| 6,826,782 | B2 | 12/2004 | Jordan | |
| 7,168,098 | B2 | 1/2007 | West | |
| 7,265,970 | B2 | 9/2007 | Jordan | |
| 7,302,710 | B2 | 12/2007 | Thomas et al. | |
| RE40,613 | E | 1/2009 | Jordan | |
| 7,519,192 | B1 | 4/2009 | Laycock et al. | |
| 7,673,348 | B2 | 3/2010 | Williams | |
| 7,841,344 | B2 | 11/2010 | Schlosser | |
| 7,992,225 | B2 | 8/2011 | Demus | |
| 8,107,653 | B2 | 1/2012 | Wolfe | |
| 8,549,670 | B2 | 10/2013 | Demus | |
| 8,613,112 | B2 | 12/2013 | Santucci et al. | |
| 8,687,834 | B2 | 4/2014 | Wolfe | |
| 8,756,716 | B2 | 6/2014 | Jordan et al. | |
| 9,009,867 | B2 | 4/2015 | Bowen et al. | |
| 9,332,796 | B2 | 5/2016 | Edwards et al. | |
| 2002/0124294 | A1 | 9/2002 | McKenzie et al. | |
| 2008/0067202 | A1 | 3/2008 | Silva et al. | |
| 2010/0308086 | A1 | 12/2010 | Chapuis | |
| 2012/0045084 | A1 | 2/2012 | Groset et al. | |
| 2014/0053854 | A1 | 2/2014 | Barry, Jr. | |
| 2014/0304885 | A1 | 10/2014 | Oliver | |
| 2015/0196061 | A1 | 7/2015 | Oliver | |
| 2016/0309819 | A1 | 10/2016 | Edwards et al. | |

FOREIGN PATENT DOCUMENTS

| | | | |
|---|---|---|---|
| WO | 02/080714 | A1 | 10/2002 |
| WO | 2008/025043 | A1 | 3/2008 |

OTHER PUBLICATIONS

International Search Report and Written Opinion for PCT/US15/40787 dated Jan. 12, 2016, all pages.

International Preliminary Report on Patentability for PCT/US15/40787 dated Sep. 16, 2016, all pages.

* cited by examiner

TECHNOLOGY BACKPACK

CROSS-REFERENCES TO RELATED APPLICATIONS

The present application is a non-provisional of and claims priority to U.S. Provisional Application No. 62/376,847, filed Aug. 18, 2016, which is hereby incorporated by reference in its entirety for all purposes. This application is a Continuation-In-Part of U.S. Nonprovisional application Ser. No. 15/005,899, filed Jan. 25, 2016, which is a continuation of U.S. Pat. No. 9,332,796, issued May 10, 2016, which is a non-provisional of and claims priority to U.S. Provisional Patent Application No. 62/025,829, filed Jul. 17, 2014; all of which are hereby incorporated by reference in their entirety.

The present application is also related to U.S. Nonprovisional application Ser. No. 15/681,231, filed concurrently herewith which is hereby incorporated by reference in its entirety for all purposes.

BACKGROUND OF THE INVENTION

A portion of the disclosure of this patent document contains material, which is subject to copyright and/or mask work protection. The copyright and/or mask work owner has no objection to the facsimile reproduction by anyone of the patent document or the patent disclosure, as it appears in the Patent and Trademark Office patent file or records, but otherwise reserves all copyright and/or mask work rights whatsoever.

Bags such as backpacks have not evolved as quickly as other personal items have.

Technology such as drinking flasks, hydration bladders, vapor pens, oxygen generators, music players, etc. have become necessities of modern life to some. Solutions are needed that would evolve bag design and use modern technology in a more functional way.

Persons who choose to drink or smoke cigarettes in public must currently do so in a manner that is very conspicuous and even irritating to others. Often, persons who prefer to enjoy their vices in public may wish to be more discreet about their "habit." Bags are known to carry and store items, but only in a conventional manner that requires users to find then remove items from the bag entirely in order to use the technology.

Users of technology items have strong preferences toward their particular device of choice. Technology items come in different configurations and sizes; for example, there are many different sizes of technology tanks. Integrating configurations and sizes in an easy and convenient way to make the technology portable, readily accessible and inconspicuous poses a problem.

BRIEF SUMMARY OF THE INVENTION

One general aspect of the present invention includes a bag with integrated technology chambers for housing a technology tank while also enabled to house a hydration bladder, the bag including: a body including a compartment; and a shoulder strap connected to an upper portion of the body and a lower portion of the body. The shoulder strap includes: a first technology chamber, and the first technology chamber is sized to hold a first technology tank that supplies a fluid. The shoulder strap also includes a first internal conduit, and a first portal to the first technology chamber, wherein the first portal is sized to pass a first tube from inside the shoulder strap to outside the shoulder strap. The bag also includes that the first portal is reinforced and is connected to the first conduit and that the first conduit is connected to the first technology chamber. The bag also includes a second technology chamber located in the body, including a second technology tank, where the second technology tank supplies a liquid. The bag also includes a second conduit; a second portal, where the second portal is connected to the second conduit. The bag also includes the second portal is sized to pass a second tube from inside the second technology chamber to the second conduit. The bag also includes that the second portal is reinforced.

Additional embodiments of this aspect of the invention may include one or more of the following features. A first additional embodiment is the bag with integrated technology chamber for housing a technology tank and enabled for hydration where: the shoulder strap length is at least twice as long as the shoulder strap width and includes that the first technology chamber is located on a portion of the shoulder strap proximate to the lower portion of the body. Another embodiment is the bag with integrated technology chamber for housing a technology tank and enabled for hydration where the first technology chamber includes a closure including a zipper, a hook and loop fastener, a snap, and/or a button. A further embodiment is the bag with integrated technology chamber for housing a technology tank and enabled for hydration further including: the shoulder strap having a long edge, a holding band, where the holding band is configured to hold the first tube in place on a portion of the shoulder strap while the holding band is positioned perpendicular to the long edge. And yet another embodiment is the bag with integrated technology chamber for housing a technology tank and enabled for hydration the shoulder strap further including a third technology chamber, where the third technology chamber is located on the shoulder strap and positioned at a location proximate to the lower portion of the body, or proximate to the upper portion of the body; or proximate to a mid-point between the lower portion of the body and the upper portion of the body, where the third technology chamber is sized to store a mouthpiece end of the tube. And a further embodiment is the bag with integrated technology chamber for housing a technology tank and enabled for hydration where the bag includes a backpack, messenger bag, knapsack, over-the-shoulder bag, or purse. Yet another additional embodiment is the bag with integrated technology chamber for housing a technology tank and enabled for hydration where the fluid is a vaporous gas.

A second general aspect of the present invention includes a bag with integrated technology chamber for housing and screening a technology tank and attachments, the bag including a body including a compartment and a shoulder strap connected to an upper portion of the body and a lower portion of the body. The shoulder strap including a first technology chamber, where: the first technology chamber is sized to hold a first technology tank; and the first technology tank supplies a fluid. The shoulder strap further includes a first conduit internal to the shoulder strap, and the first conduit is connected to the first technology chamber; and the shoulder strap has an inner portion, where the inner portion is located opposed to the body.

Further embodiments of this aspect of the invention may include one or more of the following features. A first additional embodiment is the bag with integrated technology chamber for housing and screening a technology tank and attachments further including: a second technology chamber located in the body, including: a second technology tank, where the second technology tank supplies a liquid; a second conduit; a second portal, where: the second portal is connected to the second conduit; the second portal is sized to pass a second tube from inside the second technology chamber to the second conduit; and the second portal is reinforced. A second additional embodiment is the bag with integrated technology chamber for housing and screening a technology tank and attachments where: the first technology chamber includes a closure including a zipper, a hook and loop fastener, a snap, and/or a button; and the first technology chamber is located on the inner portion. A third additional embodiment of the bag with integrated technology chamber for housing and screening a technology tank and attachments further including: the shoulder strap having a long edge; a holding band, the holding band configured to hold a first tube in place on a portion of the shoulder strap, where the holding band is positioned perpendicular to the long edge; and the holding band is located on the inner portion. And a fourth additional embodiment of the bag with integrated technology chamber for housing and screening a technology tank and attachments the shoulder strap further including: a third technology chamber, where the third technology chamber is located on the shoulder strap and positioned at a location proximate to the lower portion of the body, or proximate to the upper portion of the body; or proximate to a mid-point between the lower portion of the body and the upper portion of the body; and the third technology chamber is located on the inner portion. Yet a fifth embodiment of the present aspect is the bag with integrated technology chamber for housing and screening a technology tank and attachments where: the shoulder strap length is at least twice as long as the shoulder strap width; the first technology chamber is located on the inner portion; and the first technology chamber is located on a portion of the shoulder strap proximate to the lower portion of the body or proximate to the upper portion of the body. And a sixth embodiment is the bag with integrated technology chamber for housing and screening a technology tank and attachments where the fluid is a vaporous gas.

Yet another general aspect of the invention includes a bag with integrated technology chamber for housing a technology tank, the bag including: a body including a compartment; and a shoulder strap connected to an upper portion of the body and a lower portion of the body, the shoulder strap including: a first technology chamber, where: the first technology chamber is sized to hold a first technology tank; and the first technology tank supplies a fluid, a first conduit internal to the shoulder strap, and a first portal to the first technology chamber, where: the first portal is sized to pass a first tube from inside the shoulder strap to outside the shoulder strap; the first portal is reinforced; the first portal is connected to the first conduit; and the first conduit is connected to the first technology chamber.

Implementations of this aspect of the invention may include one or more of the following features. A first implantation is the bag with integrated technology chamber for housing a technology tank, further including: a second technology chamber located in the body, including: a second technology chamber located in the body, including: a second technology tank, where the second technology tank supplies a liquid; a second conduit; a second portal, where: the second portal is connected to the second conduit; the second portal is sized to pass a second tube from inside the second technology chamber to the second conduit; and the second portal is reinforced. A second implementation of the present aspect of the invention is the bag with integrated technology chamber for housing a technology tank where the first technology chamber includes a closure including a zipper, a hook and loop fastener, a snap, and/or a button. A third implementation is the bag with integrated technology chamber for housing a technology tank further including: the shoulder strap having a long edge; and a holding band, the holding band configured to hold the first tube in place on an exterior portion of the shoulder strap, where the holding band is positioned perpendicular to the long edge. And a fifth implementation is the bag with integrated technology chamber for housing a technology tank the shoulder strap further including: a third technology chamber, where the third technology chamber is located on the shoulder strap and positioned at a location proximate to the lower portion of the body, or proximate to the upper portion of the body; or proximate to a mid-point between the lower portion of the body and the upper portion of the body; and the third technology chamber is sized to store a mouthpiece end of the tube. Yet a sixth implementation is the bag with integrated technology chamber for housing a technology tank where the fluid is a vaporous gas.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

In the appended figures, similar components and/or features may have the same reference label. Where the reference label is used in the specification, the description is applicable to any one of the similar components having the same reference label.

DETAILED DESCRIPTION OF THE INVENTION

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment. It is understood that various changes may be made in the function and arrangement of elements without departing from the spirit and scope as set forth in the appended claims.

A technology bag as described herein allows its carrier to indulge in vaping or drinking inconspicuously. Alternatively, the technology bag as described herein allows its carrier quick access to deliver a burst of vapor externally, as in pepper spray for personal protection or scenting as used in hunting. The technology bag comprises various technology compartments for various technology components including technology tanks, bladders, tubes, and other associated attachments. The technology bag as described can also provide a safety releasable coupling such that the various technology will "break-away" easily if snagged or caught. In one embodiment, the technology bag is a backpack as described herein. It should be understood that the present description could be directed to a messenger bag, knapsack, purse, or any over-the-shoulder style bag employing a shoulder strap. In each of these embodiments the shoulder strap is operable as described herein.

Figure 1:
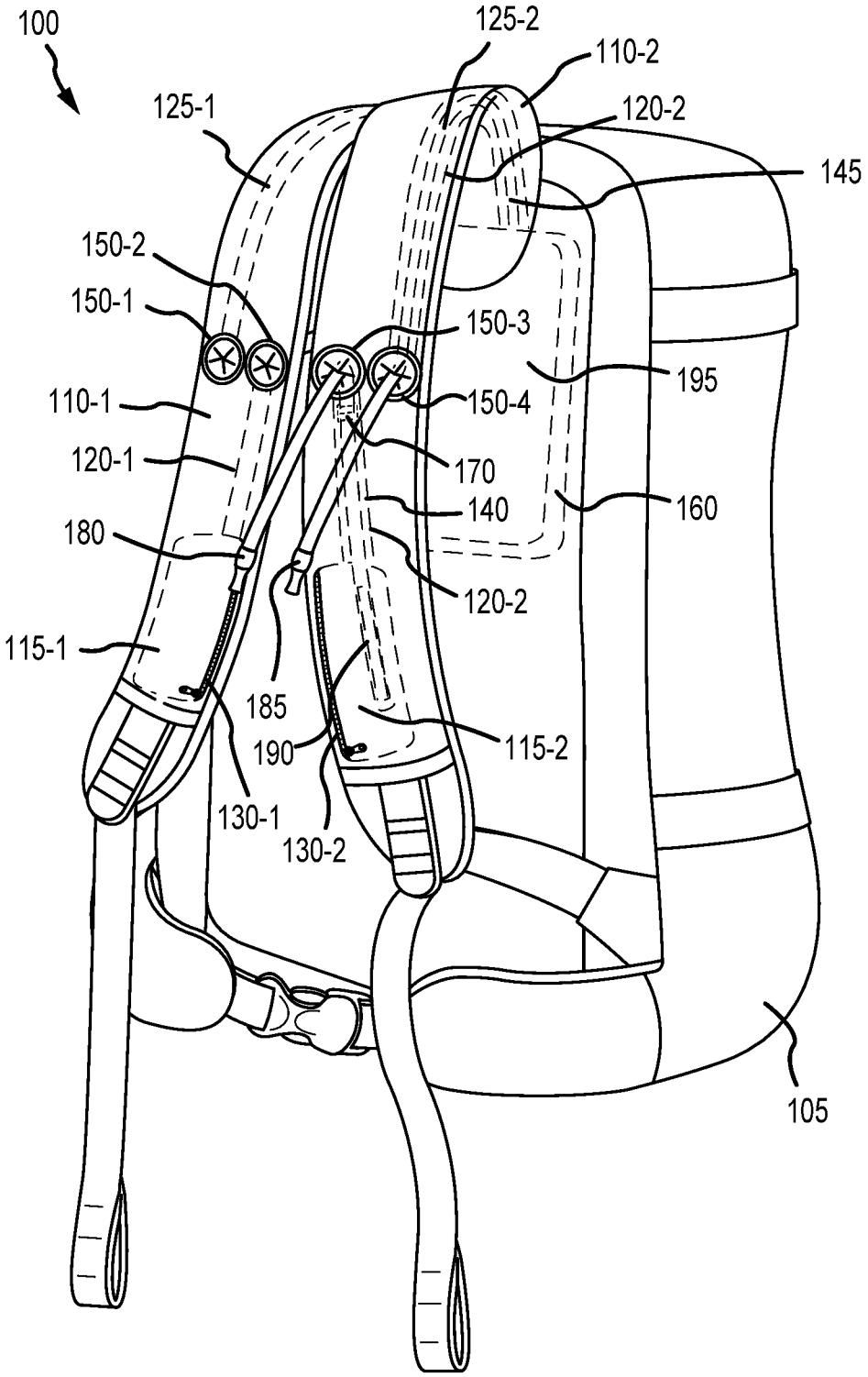
FIG. 1 depicts a first embodiment of the technology backpack with two technology capable shoulder straps and a second technology chamber.

Referring initially to FIG. 1, an embodiment of technology backpack 100 is shown with technology capability. The body 105 of the backpack 100 is shown with two shoulder straps 110-1 and 110-2 that are configured to respectively go over shoulders of a wearer. The shoulder strap 110-1 comprises a technology chamber 115-1 with a closure 130-1. The shoulder strap 110-1 also comprises a first conduit 120-1, extending from the technology chamber 115-1 to the portal 150-2. The shoulder strap 110-1 further comprises a second conduit 125-1 extending into the body 105 of the backpack 100 from a portal 150-1. Shoulder strap 110-2 comprises a first technology chamber 115-2 with a closure 130-2 and enclosing a technology tank 190. Shoulder strap 110-2 further comprises a first conduit 120-2 extending from the technology chamber 115-2 to the portal 150-3 and enclosing a first tube 140. First tube 140 runs from the technology tank 190 to the portal 150-3. First tube 140 is connected to a technology coupler 170 on one end and to a first mouthpiece 180. Shoulder strap 110-2 further comprises a second conduit 125-2 extending from portal 150-4 to the body 105. Conduit 125-2 encloses a second tube 145 extending into the body 105 and connecting with a second technology chamber 160 at a second technology tank 195 at one end and to a second mouthpiece 185 at the other end. Portal 150 is more complete described in FIGS. 10A-10C.

Backpack 100 is a bag with a body 105 and shoulder straps 110. While pictured a s backpack 100 in this embodiment, in other embodiment the bag may be an over-the-shoulder bag such as a briefcase, a messenger bag, a knapsack, or a purse. Body 105 may be comprised of any number of fabric types including nylon, polyester, polyurethane, canvas, cotton, silk, or any other suitable material or combination of any two or more of those. Body 105 may comprise any over-the-shoulder bag including a briefcase, a messenger bag, knapsack, or purse. Body 105 is sized to fit a storage compartment inside body 105 at least large enough to fit the second technology chamber 160.

Shoulder straps 110 extend from the top portion of the body 105 to the lower portion of the body 105 respectively. Shoulder straps 110 may be comprised of any number of fabric types including nylon polyester, polyurethane, canvas, cotton, silk, or any other suitable material. Shoulder straps 110 may be padded for comfort and easy concealment of the first technology chambers 115. Shoulder straps 110 may be at least twice as long in length as they wide in width and typically 5 times. Shoulder straps 110 may range from 1 to 5 inches wide. Shoulder straps 110 may be comprised of an insulating material or layer. First technology chamber 115 is incorporated into shoulder strap 110. First technology chamber 115 maybe positioned with a closure 130 along the length of the shoulder strap 110 or running perpendicular to that and across the width of the shoulder strap 110. The shoulder strap 110-1 and the shoulder strap 110-2 in this embodiment are mirror images of each and are intended to give the carrier of backpack 100 the choice of selecting either shoulder strap 110 for technology storage—or both simultaneously (not pictured). First technology chamber 115 may be sized to hold one or more technology tanks 190 as well as other associated technology or personal technology such as cell phones, smart phones portable music players or GPS devices. First technology chamber 115 may be located on the inner portion of the shoulder strap 110 to provide more screening and privacy or on the outer portion of the shoulder strap 110 for easy access. First technology chamber 115 may comprise the same fabrics of the body 105 or may have insulating material or may be a completely different fabric, including waterproof.

First technology chamber 115 is connected by first conduit 120 to a portal 150. First conduit 120 is sized to fit the first tube 140. First conduit 120 is more fully described at FIG. 9. First conduit 120 may be less than half of the size of the width of the shoulder strap in most cases. First conduit 120 may extend from the first technology chamber 115 to the portal 150 for typically 10 inches or less. The first conduit 120 may be a conduit created by stitching a portion of the interior of the shoulder strap 110. The first conduit 120 may be a separated channel in the shoulder strap 110 made of the same types of fabric as the body 105, or may be made of insulting material, or may be made of any material suitable for passing the first tube.

Second conduit 125 connects the body 105 to the portal 150, or in some cases to the first technology chamber 115. Second conduit 125 is described more fully at FIG. 9. Second conduit 125 extends from the portion of the shoulder strap 110 that is affixed to the upper portion of the body 105. Second conduit 125 may be created by stitching a portion of the interior of the shoulder strap 110 or other separation means. Second conduit 125 may be a separate channel in the shoulder strap 110 made of the same types of fabric as the body 105, or may be made of insulating material, or may be made of any material suitable for passing the second tube 145. Second conduit 125 may intersect portal 150 or may extend to technology chamber 115. Second conduit 125 is sized to accommodate the second tube 145.

Closure 130 is a closure mechanism for closing the technology chamber 115. Closure 130 can run parallel to the length of the shoulder strap 110 or parallel to the width of shoulder strap 110. Closure 130 is sized to close the technology chamber 115. Closure 130 may comprise a zipper, a hook and loop fastener, buttons, snaps, or any other closure mechanism suitable for the shoulder strap 110. Closure 130 may be on the external portion of the shoulder strap 110 or the internal portion closest to the wearer of the shoulder strap. First tube 140 connects the technology tank 190 to a first mouthpiece 180 and may do so in first conduit 120. First tube 140 may comprise flexible material that is safe for passing fluids to be consumed by humans. First tube 140 may comprise material that is high heat stable. First tube 140 is sized to fit coupler 170 and/or first mouthpiece 180. First tube 140 will generally be less than half of the length of shoulder strap 110. First tube 140 may be coupled to a releasable coupler 170 more fully described at FIG. 11. First tube 140 may be directly connected to first mouthpiece 180. Second tube 145 may comprise flexible material that is safe for passing fluids to be consumed by humans. Second tube 145 may be connected at one end of a second technology tank 195 housed in second technology chamber 160. Second tube 145 may extend the entire length of the shoulder strap 110 or any portion of the shoulder strap 110. Second tube 145 may be encapsulated by second conduit 125. Second tube 145 may be connected to second mouthpiece 185.

Figure 10A:
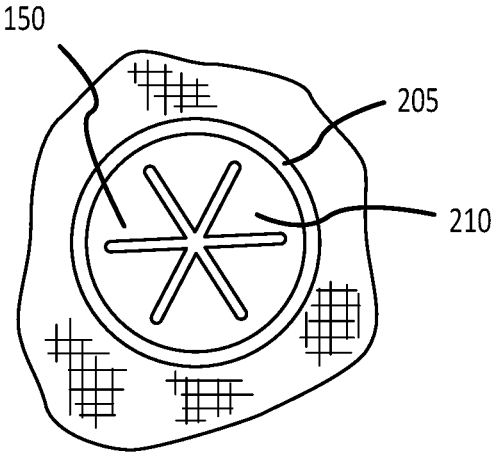
FIG. 10A depicts a round portal.
Figure 10B:
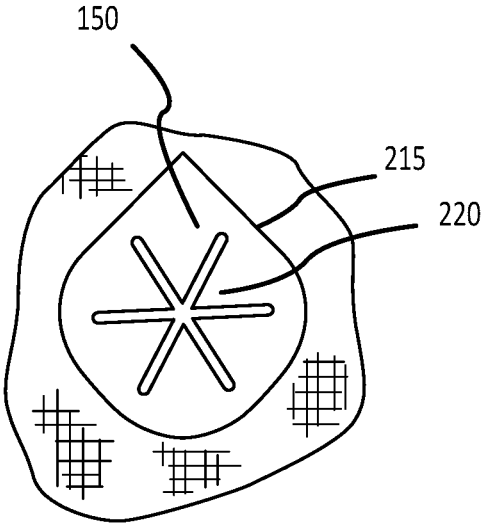
FIG. 10B depicts a droplet-shaped portal with inner star section.
Figure 10C:
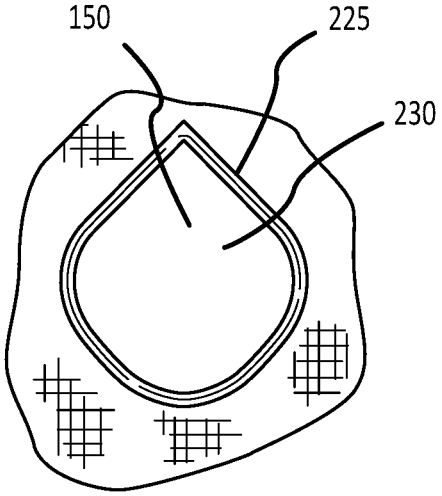
FIG. 10C depicts a droplet-shaped portal.

Portals 150 are more fully described in FIGS. 10A-10C. Second technology chamber 160 is a part of the body 105 and typically located on the interior portion of the body 105. Second technology chamber 160 is sized typically bigger than first technology chamber 115. Second technology chamber 160 may be sewn into the back of the bag 105 or connected in any other way to accommodate second technology tank 195. Second technology chamber 160 is sized to be up to as wide as the body 105 but is typically not so wide. Second technology chamber 160 may be made of the same material as the body 105 or can be an insulating material or waterproof material or any other material to house the second technology tank. Coupler 170 is more fully described in FIG. 11. First mouthpiece 180 may be made of a rigid material safe to pass fluids to humans. First mouthpiece 180 may be connected to first tube 140 directly or by coupler 170. First mouthpiece 180 is configured to pass fluid from the first tube 140, that may be connected to the first technology tank 190. First mouthpiece 180 may operate to draw fluid through tube 140 from the first technology tank 190 when a bag 100 carrier sucks on the mouthpiece 180. Second mouthpiece 185 may be made of a rigid material safe to pass fluid to humans. Second mouthpiece 185 may be connected to second tube 145 directly or by a coupler 170 (not shown). Second mouthpiece 185 is configured to pass fluid from second tube 145 that may be connected to second technology tank 195. Second mouthpiece 185 may operate to draw fluid through tube 145 from the second technology tank 195 when a bag 100 carrier sucks on the second mouthpiece 185.

The shoulder straps 110 are sized to hold a first technology chamber 115 that is sized to hold a first technology tank 190 such as oxygen canister, oxygen generator, a vapor pen, a nebulizer, a liquid bladder, air filter, and/or other liquid, smoke, vapor, or gas supplying technology. The first technology tank 190 may be made of rigid or semi-rigid material safe to hold human consumable fluids such as plastic, stainless steel, rubber, or other suitable material. First technology tank 190 may be high heat capable and capable of generating steam or vapor. The first technology tank 190 may supply fluid to first tube 140, including fluid in any form comprising liquid, gas, and vapor. First technology tank 190 may be powered and operate with a power supplying device such as a battery. First technology tank 190 may be sized to fit in the first technology chamber 115 in the shoulder strap 110. First technology tank 190 maybe of a size and appearance so as to be inconspicuous inside the first technology chamber 115. The body 105 is sized to hold second technology chamber 160, that is sized to hold second technology tank 195. Second technology tank 195 may be an oxygen canister, oxygen generator, a pepper spray canister, an animal scent canister, a vapor pen, a nebulizer, a liquid bladder, an air filter, and/or another liquid, smoke, vapor, or gas supplying technology. The second technology tank 195 may be made of rigid or semi-rigid material safe to hold human consumable fluids, such as plastic, glass, stainless steel, rubber, or other suitable material. The second technology tank 195 may supply fluid to second tube 145, including fluid in any form comprising liquid, gas, and vapor. Second technology tank 195 may be powered and operate with a power supplying device such as a battery.

Figure 2A:
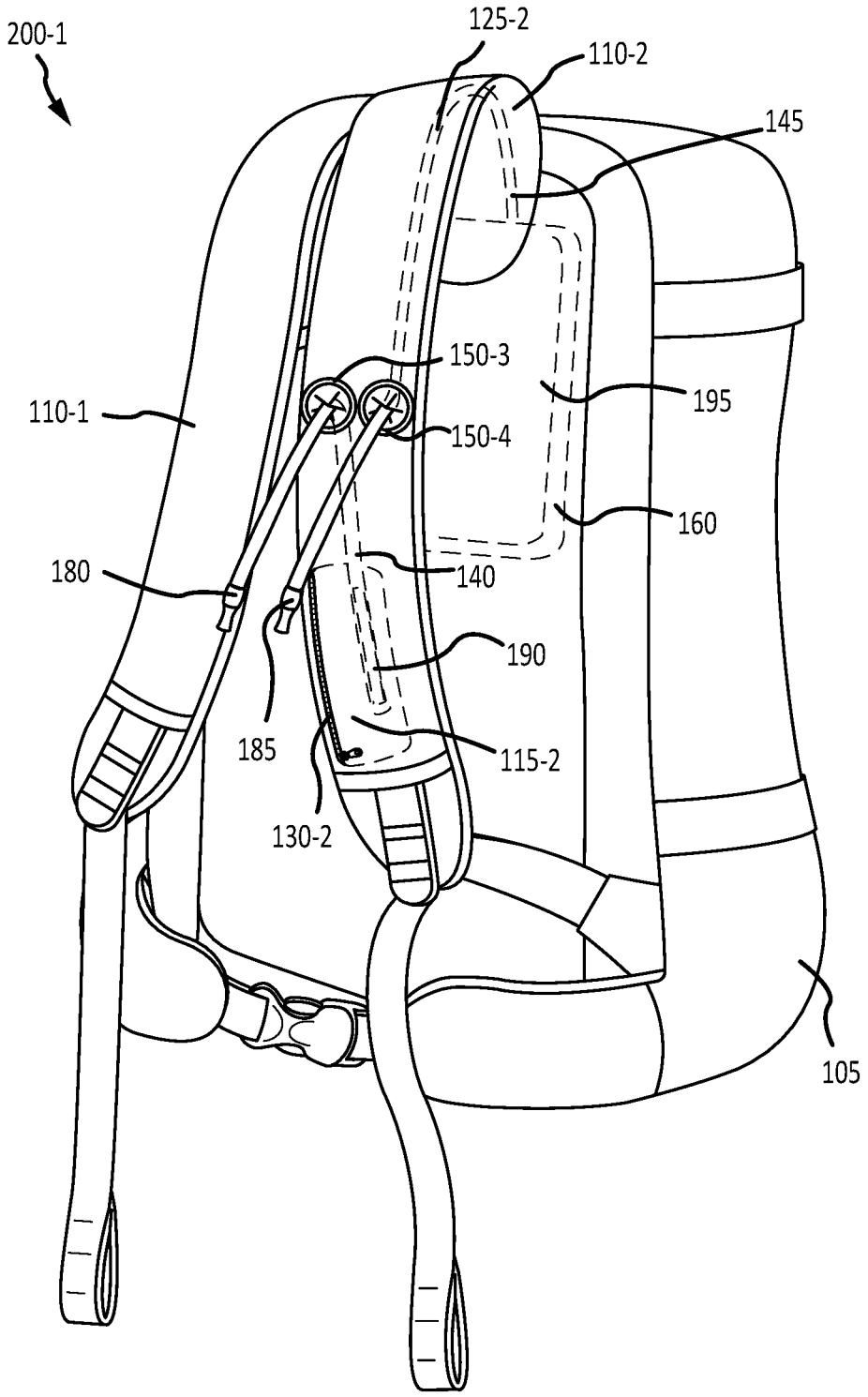
FIG. 2A depicts a second embodiment of the technology backpack with one technology capable shoulder strap and a second technology chamber.

Referring next to FIG. 2A, another embodiment of the technology backpack 200-1 is shown. In this embodiment technology backpack 200-1 comprises a body 105 and shoulder straps 110-1 and 110-2 connected at the top portion of the body 105 and the bottom portion of the body 105 respectively. Shoulder strap 110-2 comprises a first technology chamber 115 with closure 130. First technology chamber 115 holds a first technology tank 190 and first tube 140 connects first technology tank 190 to first mouthpiece 180 through portal 150-3. The first technology chamber 115 may have a closure 130. Shoulder strap 110-2 further comprises second mouthpiece 185 that passes through portal 150-4 an is connected to the second tube 145 on one end of second technology tube 145. Second tube 145 passes through shoulder strap 110 to body 105 and into second technology chamber 160 connecting to the second technology tank 195 inside the second technology chamber 160.

The body 105, first technology chamber 115, closure 130, first tube 140, second tube 145, second technology chamber 160, first mouthpiece 180, second mouthpiece 185, first technology tank 190, and second technology tank 195 are fully described in FIG. 1. Portals 150 are fully described in FIGS. 10A-10C. Shoulder straps 110 extend from the top portion of the body 105 to the lower portion of the body 105 respectively Shoulder straps 110 may be comprised of any number of fabric types including nylon polyester, polyurethane, canvas, cotton, silk, or any other suitable material. Shoulder straps 110 may be padded for comfort and easy concealment of the first technology chamber 115. Shoulder straps 110 may be at least twice as long in length as they wide in width and typically 5 times. Shoulder traps 110 may range from 1 to 5 inches wide. Shoulder straps 110 may be comprised of an insulating material or layer. First technology chamber 115 is incorporated into shoulder strap 110-2. First technology chamber 115 maybe positioned with a closure 130 along the length of the shoulder strap 110-2 or running perpendicular to that and across the width of the shoulder strap 110. First tube 140 and second tube 145 are partially held in the interior portion of the shoulder strap 110-2 such that the entire inner width of the shoulder strap 110-2 forms a passageway for first tube 140 and second tube 145.

Figure 2B:
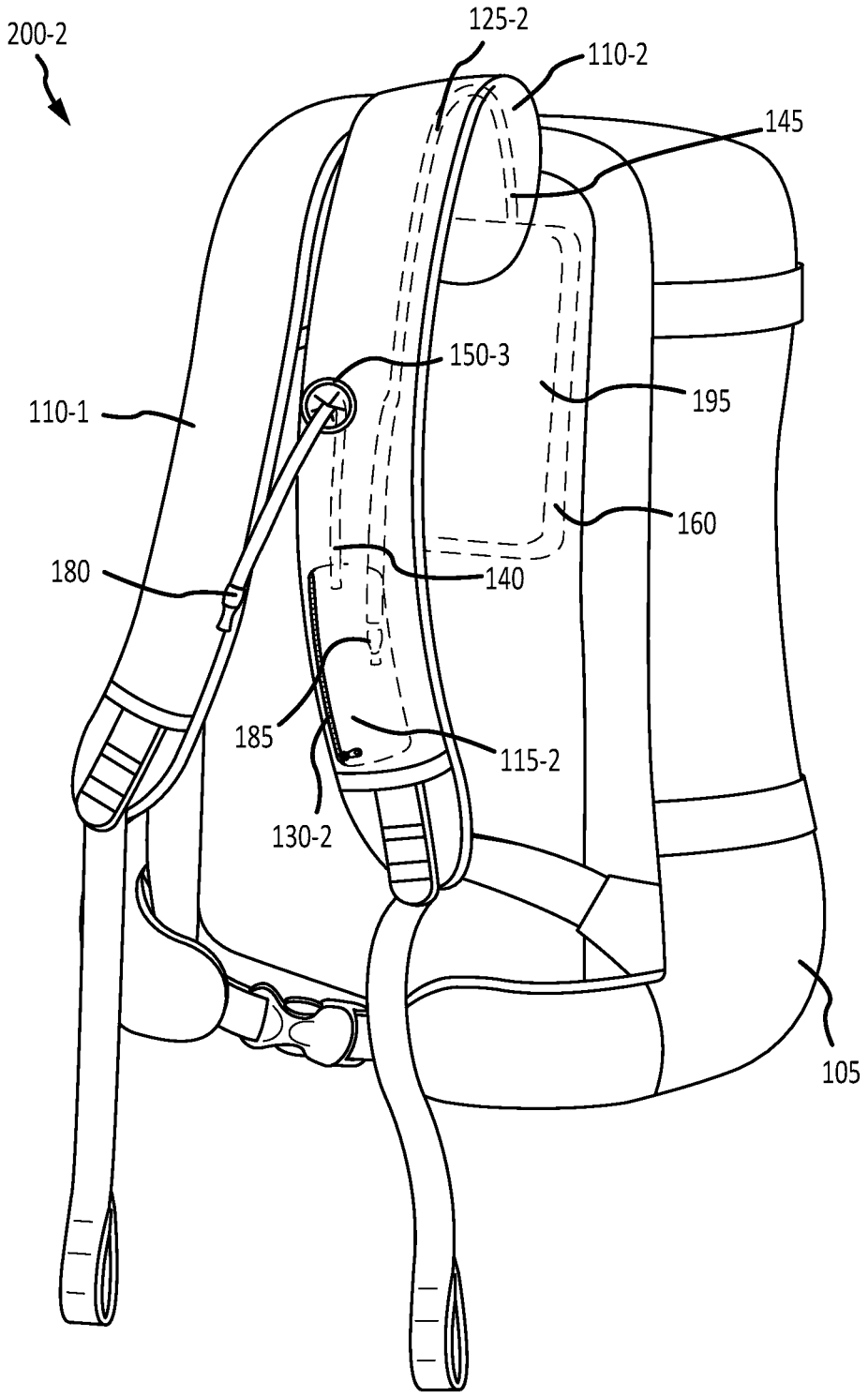
FIG. 2B depicts another embodiment of the technology backpack with one technology capable shoulder strap with a single portal.

With reference to FIG. 2B, an embodiment of the technology back 200-2 is shown. This embodiment has a single portal 150-3 in the shoulder strap 110 to pass the first tube 140. A second tube 145 is routed through the shoulder strap 110 internally. Liquids passing through the second tube 145 are less likely to freeze as the conduit 125-2 provides insulation. The mouthpiece 185 is pulled out from the first technology chamber 115 for the wearer to consume the liquids. The mouthpiece 185 is a bite valve in this embodiment, but could be a one-way valve in other embodiments. When pulled, the second tube 145 has extra length that can slide within the conduit 125-2.

Figure 3:
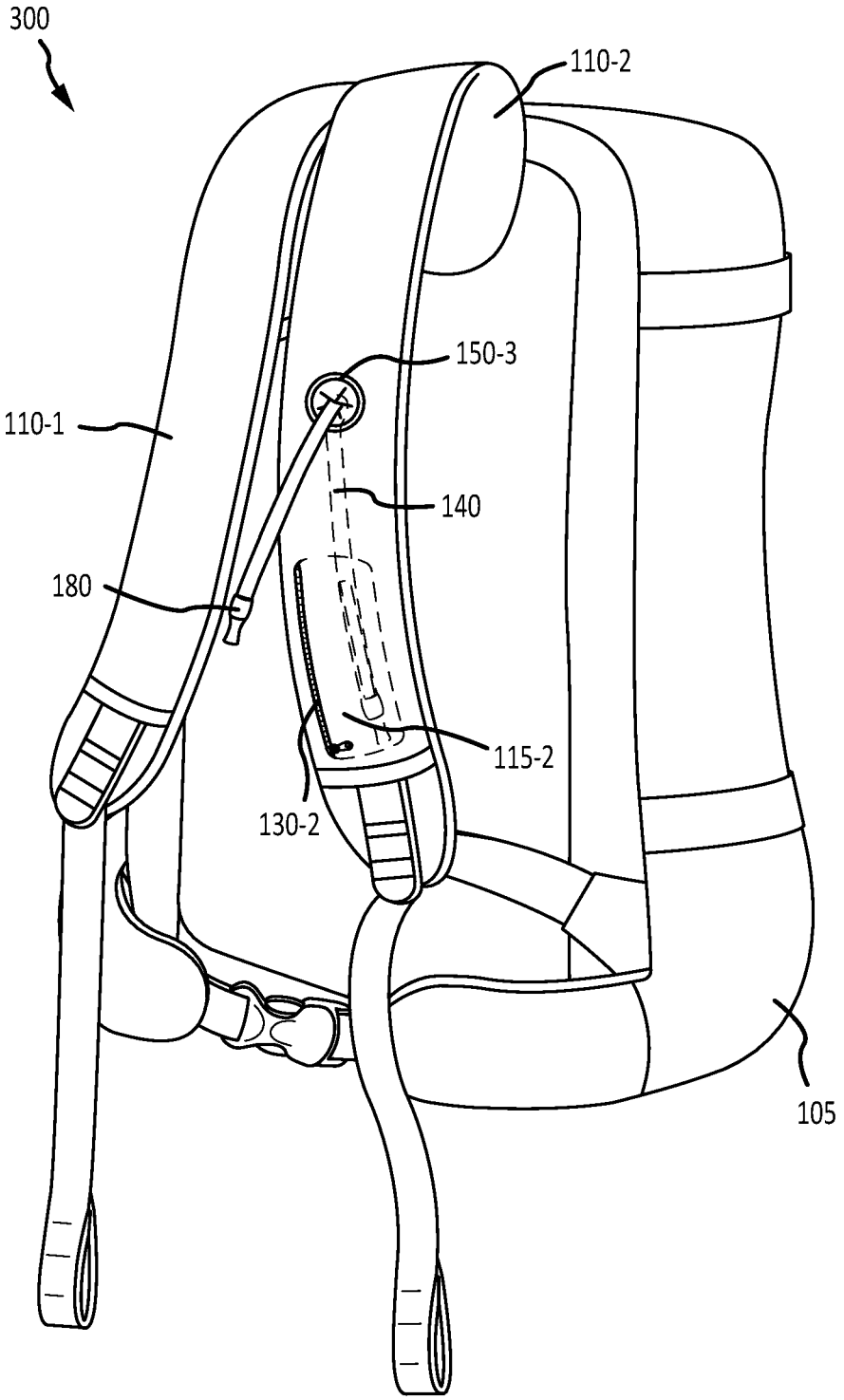
FIG. 3 depicts a third embodiment of the technology backpack with one technology capable shoulder strap.

Referring next to FIG. 3, a further embodiment of the technology backpack 300. In this embodiment technology backpack 300 comprises a body 105 and shoulder straps 110-1 and 110-2 connected at the top portion of the body 105 and the bottom portion of the body 105 respectively. Shoulder strap 110-2 comprises a first technology chamber 115 with closure 130. First technology chamber 115 holds a first technology tank 190 and first tube 140 connects first technology tank 190 to first mouthpiece 180 through portal 150. The first technology chamber may have a closure 130.

The body 105, first technology chamber 115, closure 130, first tube 140, the first mouthpiece 180, and first technology tank 190 are fully described in FIG. 1. Portals 150 are fully described in FIGS. 10A-10C. Shoulder straps 110 extend from the top portion of the body 105 to the lower portion of the body 105 respectively Shoulder straps 110 may be comprised of any number of fabric types including nylon polyester, polyurethane, canvas, cotton, silk, or any other suitable material. Shoulder straps 110 may be padded for comfort and easy concealment of the first technology chamber 115. Shoulder straps 110 may be at least twice as long in length as they wide in width and typically 5 times. Shoulder traps 110 may range from 1 to 5 inches wide. Shoulder straps 110 may be comprised of an insulating material or layer. First technology chamber 115 is incorporated into shoulder strap 110-2. First technology chamber 115 maybe positioned with a closure 130 along the length of the shoulder strap 110-2 or running perpendicular to that and across the width of the shoulder strap 110. First tube 140 is partially held in the interior portion of the shoulder strap 110-2 such that the entire inner width of the shoulder strap 110-2 forms a passageway for first tube 140. It is readily apparent from figure and description that any bag 100 with a single shoulder strap 110 will suffice to perform all of the functions necessary.

Figure 4:
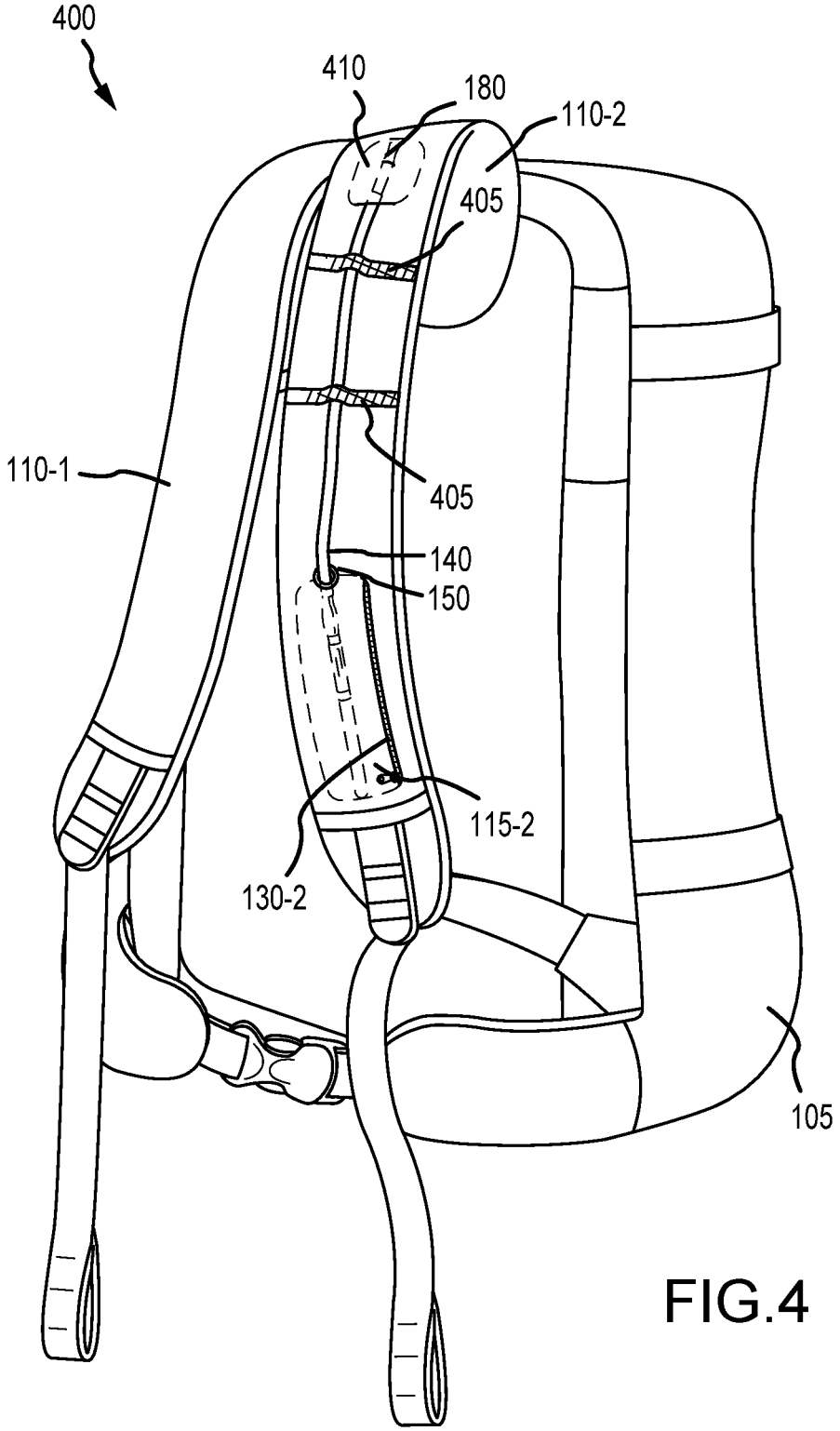
FIG. 4 depicts a fourth embodiment of the technology backpack with one technology capable shoulder strap with holding straps.

Referring next to FIG. 4, yet another embodiment of the technology backpack 400. In this embodiment technology backpack 400 comprises a body 105 and shoulder straps 110-1 and 110-2 connected at the top portion of the body 105 and the bottom portion of the body 105 respectively. Shoulder strap 110-2 comprises a first technology chamber 115 with closure 130. First technology chamber 115 holds a first technology tank 190 and first tube 140 connects to first technology tank 190. The first technology chamber may have a closure 130. The first tube 140 passes through portal 150 and extends on the outside of shoulder strap 110. The first tube 140 terminates and third technology chamber 410. The first tube 140 is held in place by strap holders 405.

The body 105, first technology chamber 115, closure 130, first tube 140, the first mouthpiece 180, and first technology tank 190 are full described in FIG. 1. Portal 150 is fully described in FIGS. 10A-10C. The shoulder strap 110 in this embodiment is fully described in FIG. 3. Technology chamber 410 is sized to fit and hold a mouthpiece in place. The technology chamber 410 can be made from the same material and body 105 but also may comprise different material including nano-material intended to keep the mouthpiece sanitized. The technology chamber 410 as depicted in this embodiment is located at the portion of the shoulder strap 110 near the upper portion of the bag, but need not be so configured and could be placed at various places on the shoulder strap 110. Strap holders 405 are configured to hold first tube 140 in place. Strap holders 405 can be elasticized or made of other material and extend across the width of shoulder strap 110 in a manner to keep first tube 140 in place. The strap holder 405 material could be nylon webbing and could be elastic in some embodiments. Although the strap holder 405 is shown as perpendicular to the first tube 140, it could be a loop circumferentially around the first tube 140.

Figure 5:
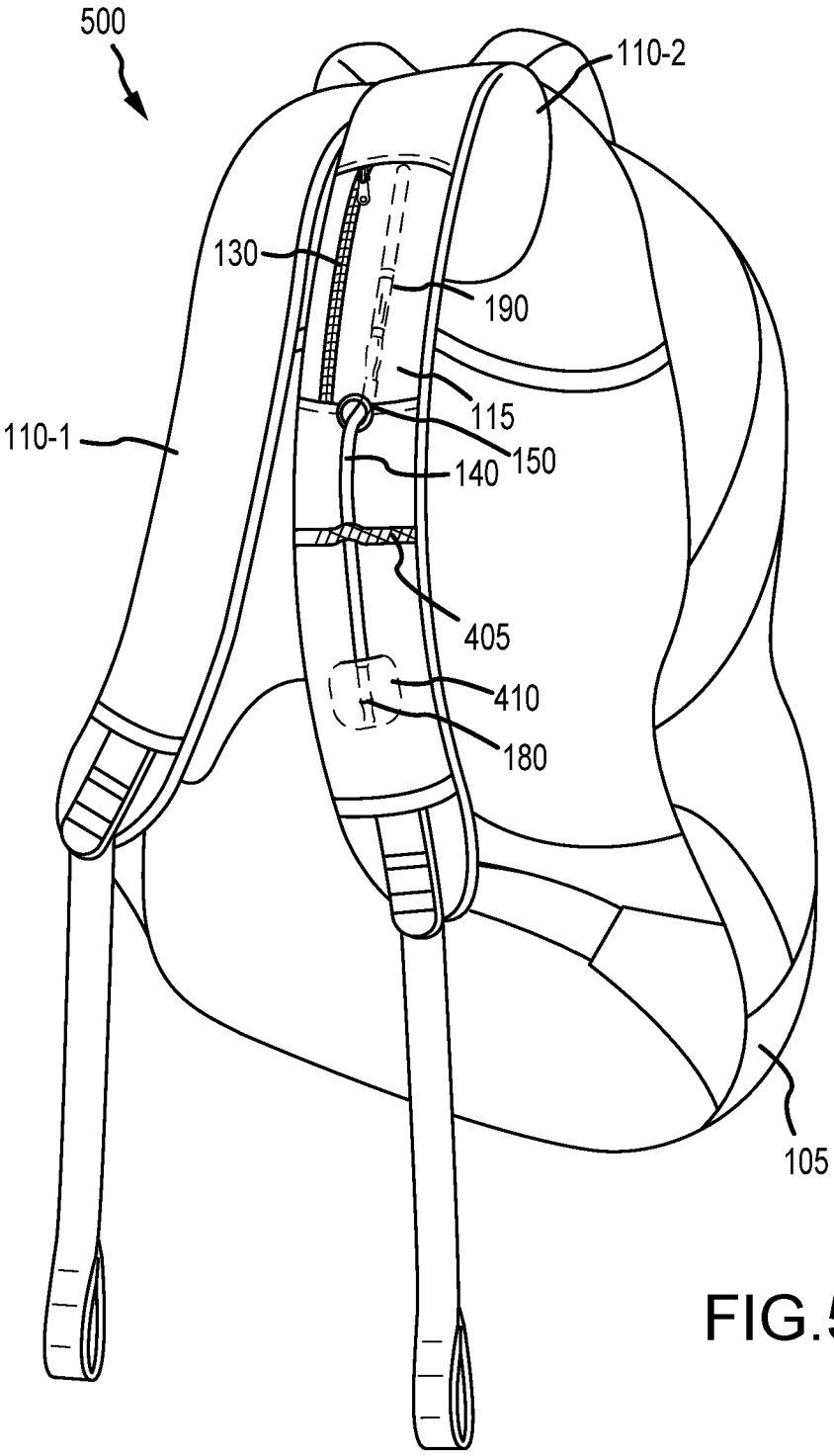
FIG. 5 depicts a fifth embodiment of the technology backpack with a third technology chamber.

Referring next to FIG. 5, still another embodiment of the technology backpack 500 is shown. In this embodiment technology backpack 500 comprises a body 105 and shoulder straps 110-1 and 110-2 connected at the top portion of the body 105 and the bottom portion of the body 105 respectively. Shoulder strap 110-2 comprises a first technology chamber 115 with closure 130. First technology chamber 115 holds a first technology tank 190 and first tube 140 connects to first technology tank 190. In this embodiment, the technology tank 190 may be pressurized. The first technology chamber may have a closure 130. The first tube 140 passes through portal 150 and extends on the outside of shoulder strap 110. The first tube 140 terminates and third technology chamber 410. The first tube 140 is held in place by strap holder 405.

The body 105, first technology chamber 115, closure 130, first tube 140, the first mouthpiece 180, and first technology tank 190 are fully described in FIG. 1. Portal 150 is fully described in FIGS. 10A-10C. The third technology chamber 410 and strap holder 405 are fully described in FIG. 4 where the components are shown in a different configuration wherein the technology chamber 115 is positioned at the top portion of shoulder strap 110 near the top portion of the body 105. The first tube extends down the shoulder strap 110 to the third termination chamber 410 located near the bottom portion of shoulder strap 110 at the point where is connected to a lower portion of body 105.

Figure 6:
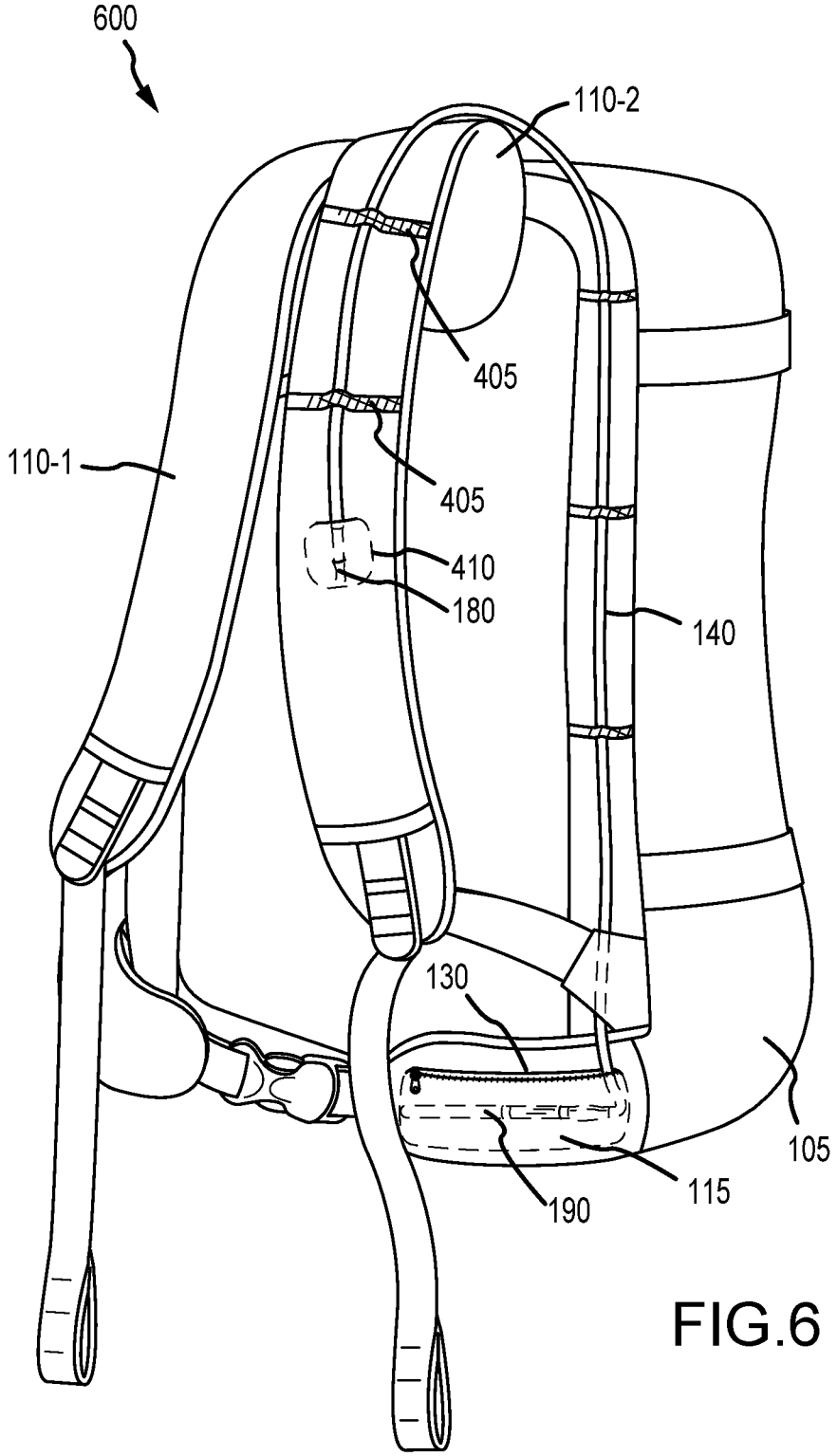
FIG. 6 depicts a sixth embodiment of the technology backpack with a first technology chamber in the body of the backpack.

Referring next to FIG. 6, an additional embodiment of the technology backpack 600. In this embodiment technology backpack 600 comprises a body 105 and shoulder straps 110-1 and 110-2 connected at the top portion of the body 105 and the bottom portion of the body 105 respectively. Body 105 comprises a first technology chamber 115 with closure 130. First technology chamber 115 holds a first technology tank 190 and first tube 140 connects to first technology tank 190. The first tube 140 passes through closure 130 and extends on the outside of the back portion of body 105 to outside of shoulder strap 110. The first tube 140 terminates and third technology chamber 410. The first tube 140 is held in place by strap holders 405.

The body 105, first technology chamber 115, closure 130, first tube 140, the first mouthpiece 180, and first technology tank 190 are fully described in FIG. 1. The third technology chamber 410 and strap holder 405 are fully described in FIG. 4. In this embodiment, the first technology chamber 115 is located in the body 105 on a bottom portion of the body 105. One of skill in the art will recognize that the first technology chamber 115 can be located at other areas of body 105.

Figure 7:
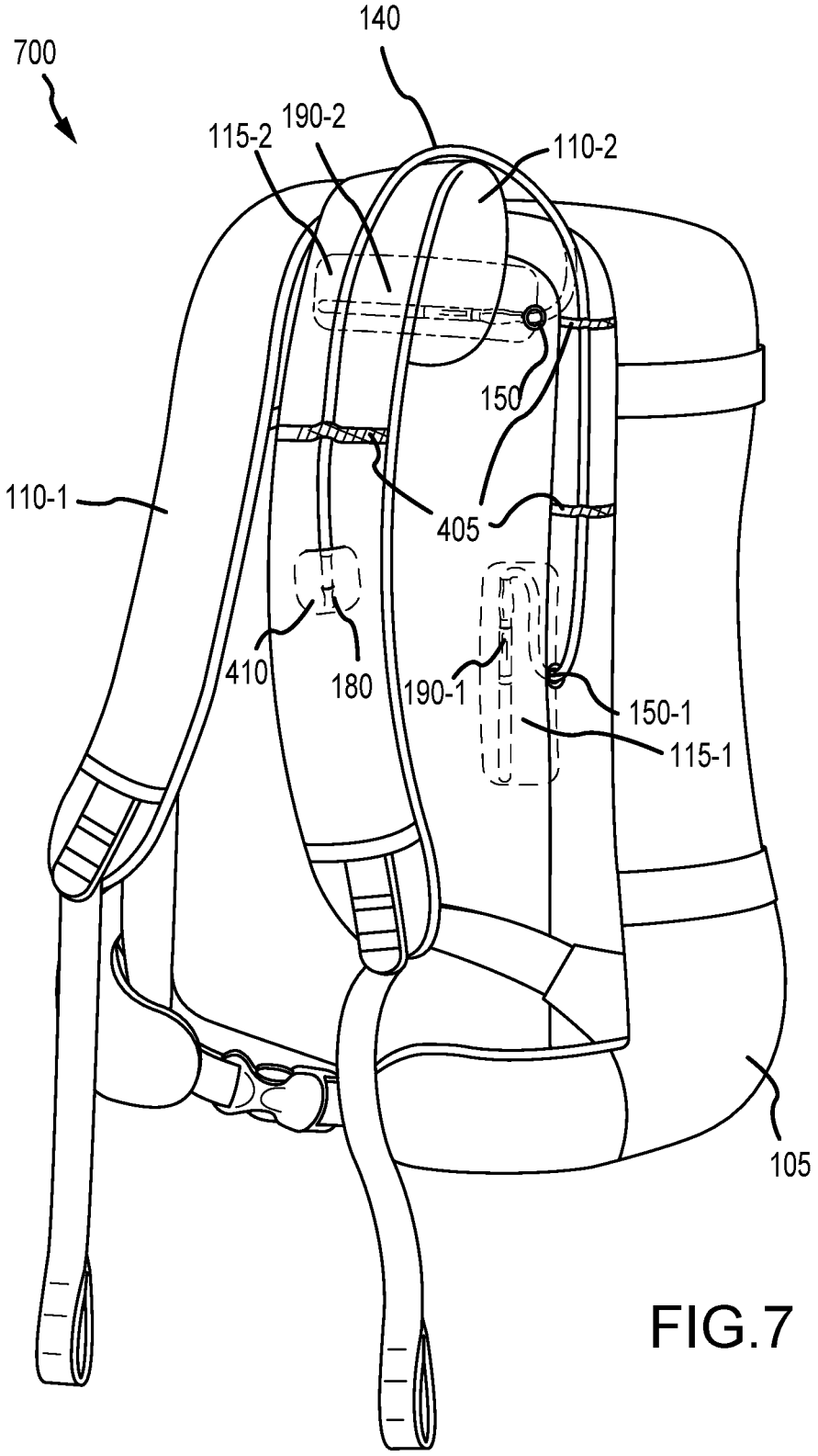
FIG. 7 depicts a seventh embodiment of the technology backpack with two first technology chambers in the body of the backpack.

Referring next to FIG. 7, an additional embodiment of the technology backpack 700. In this embodiment technology backpack 700 comprises a body 105 and shoulder straps 110-1 and 110-2 connected at the top portion of the body 105 and the bottom portion of the body 105 respectively. Body 105 comprises a first technology chamber 115-1 with closure 130 (not visible). First technology chamber 115-1 holds a first technology tank 190-1 and first tube 140 connects to first technology tank 190-1. The first tube 140 passes through portal 150-1 and extends on the outside of the side portion of body 105 to outside of shoulder strap 110. The first tube 140 terminates and third technology chamber 410. The first tube 140 is held in place by strap holders 405. There is a second first technology chamber 115-2 on the top portion of the back of body 105. The second first technology chamber 115-2 comprises a second technology tank 190-2 and provides redundancy and back up for the user.

The body 105, first technology chamber 115, closure 130, first tube 140, the first mouthpiece 180, and first technology tank 190 are fully described in FIG. 1. Portal 150 is fully described in FIGS. 10A-10C. The third technology chamber 410 and strap holder 405 are fully described in FIG. 4. In this embodiment the first technology chamber 115-1 is located in the body 105 on a side portion of the body 105. A second first technology chamber 115-2 allows a user to have a back-up first technology tank 190-2 with the same or differently fluids. Further a user may wish to alternate between fluids.

Figure 8:
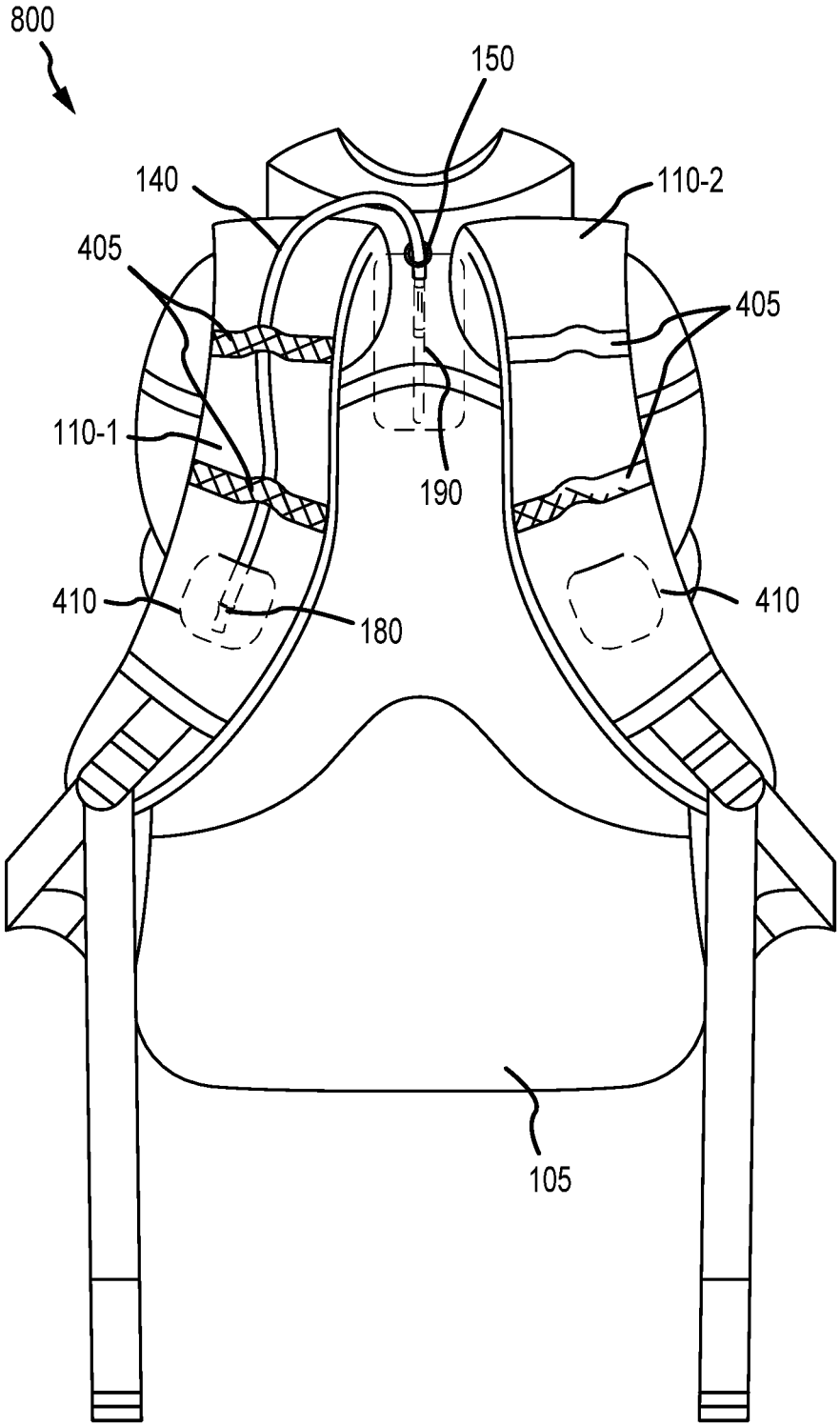
FIG. 8 depicts an eighth embodiment of the technology backpack with two third technology chambers in the shoulder straps.

Referring next to FIG. 8, an additional embodiment of the technology backpack 800. In this embodiment technology backpack 800 comprises a body 105 and shoulder straps 110-1 and 110-2 connected at the top portion of the body 105 and the bottom portion of the body 105 respectively. Body 105 comprises a first technology chamber 115 with closure 130 (not shown). First technology chamber 115 holds a first technology tank 190 and first tube 140 connects to first technology tank 190. The first tube 140 passes through portal 150 and extends to outside of shoulder strap 110-1. The first tube 140 terminates and third technology chamber 410. The first tube 140 is held in place by strap holders 405.

The body 105, first technology chamber 115, closure 130, first tube 140, the first mouthpiece 180, and first technology tank 190 are full described in FIG. 1. Portal 150 is fully described in FIGS. 10A-10C. The third technology chamber 410 and strap holder 405 are fully described in FIG. 4. In this embodiment the first technology chamber 115 is located in the body 105 on a top back portion of the body 105. Both shoulder straps 110 are configured identically with third technology chambers 410 and strap holders 405 so that the user can put first tube 140 on either their right or left sides.

Figure 9A:
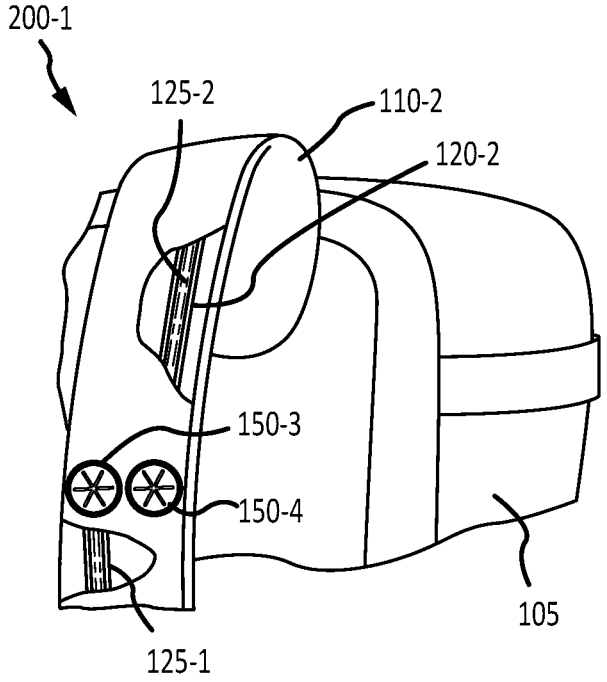
FIG. 9A depicts a cutaway of the shoulder strap.

Referring next to FIG. 9A, a cut-away exposure of the shoulder strap 110-2 connected here to the top portion of body 105 for the embodiment of FIG. 2A. The shoulder strap 110-2 comprises a first conduit 125-1 that terminates at portal 150-3 and begins in a technology chamber 115 with access through closure 130 (not shown). The second conduit 125-2 begins in the body of the bag 105 and terminates at a portal 150-4. The portal elements shown are more fully described below in FIGS. 10A-C.

Figure 9B:
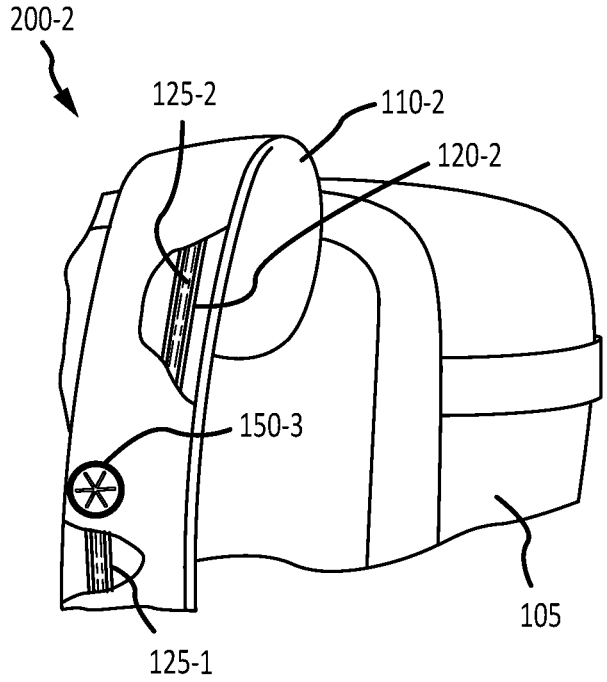
FIG. 9B depicts a cutaway of the shoulder strap.

With reference to FIG. 9B, a cut-away exposure of the shoulder strap 110-2 is shown for the embodiment of FIG. 2B.

Referring next to FIG. 10A, portal 150 is round with reinforced outside portion 205. Outside portion 205 maybe stitched, rubber, metal, plastic, heat treated—or any other mechanism to provide reinforcement for portal 150. The inner portion of portal 150 comprises a membrane 210 with a star shaped opening for tubing to pass through. The membrane 210 can be the same material as the outside portion 205, or it may be plastic, nylon, leather, rubber, or any other material that promotes tubing passage.

Referring next to FIG. 10B, portal 150 is droplet shaped with reinforced outside portion 215. Outside portion 215 maybe stitched, rubber, metal, plastic, heat treated—or any other mechanism to provide reinforcement for portal 150. The inner portion of portal 150 comprises a membrane 220 with a star shaped opening for tubing to pass through. The membrane 220 can be the same material as the outside portion 215, or it may be plastic, nylon, leather, rubber, or any other material that promotes tubing passage. FIG. 10C depicts a variation of FIG. 10D wherein the outside portion 225 is substantially the same but there is no membrane attached thereto.

Figure 11:
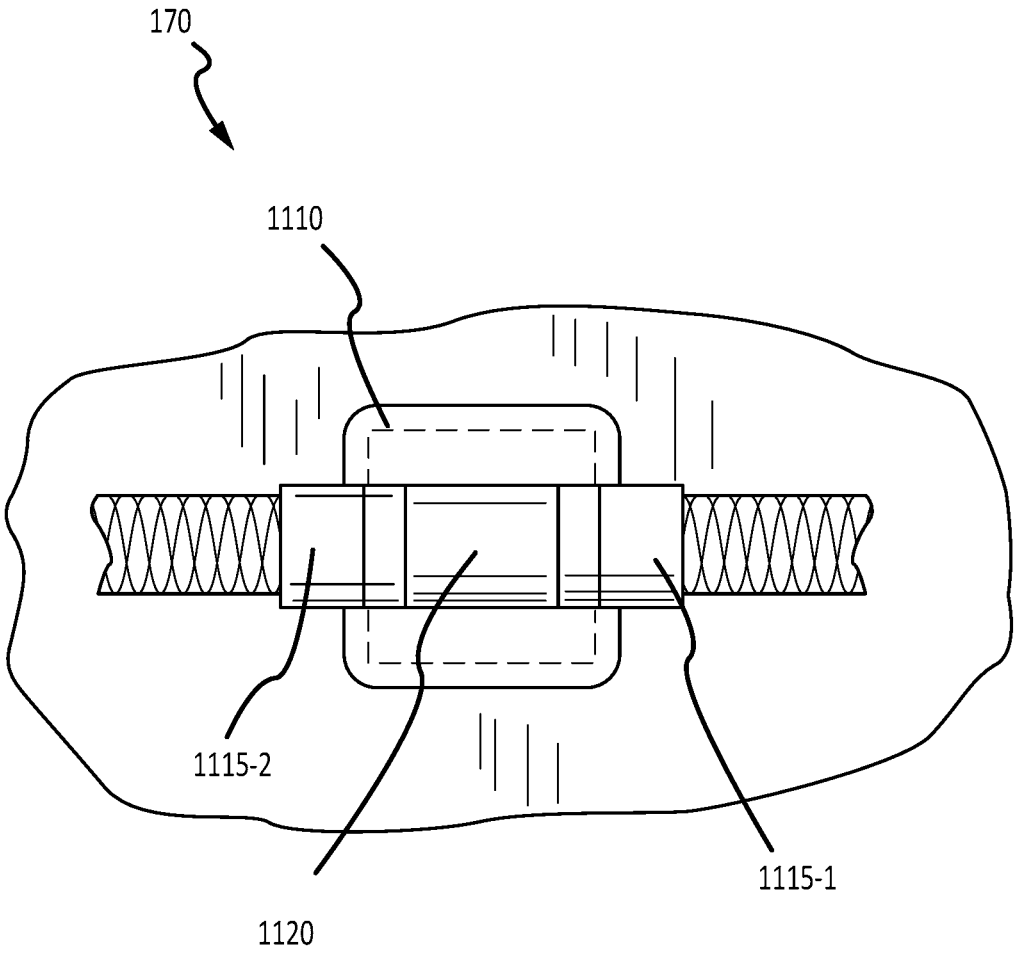
FIG. 11 depicts a an air-tight, quick-release coupler.

Referring next to FIG. 11, depicting in more detail air-tight, quick-release coupler 170. Anchor 1120 is shown with tubes 1115-1 and 1115-2 plugged into a left and right port respectively of the anchor 1120. Anchor 1120 includes a base portion 1110 for affixing to material or other objects to keep anchor 1120 in place. The base portion 1110 can be affixed by sewing, adhesive, magnet, button, etc. The left and right ports of the anchor 1120 are configured such that tubes 1115-1 and 1115-2 deliver an air-tight seal, yet can easily release from respective ports if too much pressure is applied. This is a safety and convenience feature such that should the tubing get caught or snagged—it will "break-away" from the rest of the structure as a safety feature. It also allows for easy cleaning or replacement of tubes 1115-1 and 1115-2.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

Specific details are given in the above description to provide a thorough understanding of the embodiments. However, it is understood that the embodiments may be practiced without these specific details. While the principles of the disclosure have been described above in connection with specific apparatuses and methods, it is to be clearly understood that this description is made only by way of example and not as limitation on the scope of the disclosure.

What is claimed is:

1. A bag with integrated technology chamber for housing a technology tank and enabled for hydration, the bag comprising:

a body comprising a compartment; and a shoulder strap connected to an upper portion of the body and a lower portion of the body, the shoulder strap comprising:

a first technology chamber, wherein:

the first technology chamber is sized to hold a first technology tank; and the first technology tank supplies a fluid, a first conduit internal to the shoulder strap, and a portal to the first technology chamber, wherein:

the portal is sized to pass a first tube from inside the shoulder strap to outside the shoulder strap;

the portal is reinforced;

the portal is connected to the first conduit; and the first conduit is connected to the first technology chamber; and a second technology chamber located in the body, comprising:

a second technology tank, wherein the second technology tank supplies a liquid;

a second conduit to pass a second tube from the second technology chamber to the first technology chamber.

2. The bag with integrated technology chamber for housing a technology tank and enabled for hydration of claim 1, wherein:

the shoulder strap length is at least twice as long as the shoulder strap width; and the first technology chamber is located on a portion of the shoulder strap proximate to the lower portion of the body.

3. The bag with integrated technology chamber for housing a technology tank and enabled for hydration of claim 1, wherein the first technology chamber includes a closure comprising a zipper, a hook and loop fastener, a snap, and/or a button.

4. The bag with integrated technology chamber for housing a technology tank and enabled for hydration of claim 1, further comprising:

the shoulder strap having a long edge; and a holding band, the holding band configured to hold the first tube in place on a portion of the shoulder strap, wherein the holding band is positioned perpendicular to the long edge.

5. The bag with integrated technology chamber for housing a technology tank and enabled for hydration of claim 1, the shoulder strap further comprising:

a third technology chamber, wherein the third technology chamber is located on the shoulder strap and positioned at a location proximate to the lower portion of the body, or proximate to the upper portion of the body; or proximate to a mid-point between the lower portion of the body and the upper portion of the body; and the third technology chamber is sized to store a mouthpiece end of the tube.

6. The bag with integrated technology chamber for housing a technology tank and enabled for hydration of claim 1, wherein the bag comprises a backpack, messenger bag, knapsack, over-the-shoulder bag, or purse.

7. The bag with integrated technology chamber for housing a technology tank and enabled for hydration of claim 1, wherein the fluid is a vaporous gas.

8. A bag with integrated technology chamber for housing and screening a technology tank and attachments, the bag comprising:

a body comprising a compartment; and a shoulder strap connected to an upper portion of the body and a lower portion of the body, the shoulder strap comprising:

a first technology chamber, wherein:

the first technology chamber is sized to hold a first technology tank; and the first technology tank supplies a fluid, a first conduit internal to the shoulder strap, and the first conduit is connected to the first technology chamber; and the shoulder strap has an inner portion, wherein the inner portion is located opposed to the body;

a second technology chamber located in the body, comprising:

a second technology tank, wherein the second technology tank supplies a liquid;

a second conduit;

a second portal, wherein:

the second portal is connected to the second conduit;

the second portal is sized to pass a second lube from inside the second technology chamber to the second conduit; and the second portal is reinforced.

9. The bag with integrated technology chamber for housing and screening a technology tank and attachments of claim 8, wherein:

the first technology chamber includes a closure comprising a zipper, a hook and loop fastener, a snap, and/or a button; and the first technology chamber is located on the inner portion.

10. The bag with integrated technology chamber for housing and screening a technology tank and attachments of claim 8, further comprising:

the shoulder strap having a long edge;

a holding band, the holding band configured to hold a first tube in place on a portion of the shoulder strap, wherein the holding band is positioned perpendicular to the long edge; and the holding band is located on the inner portion.

11. The bag with integrated technology chamber for housing and screening a technology tank and attachments of claim 8, the shoulder strap further comprising:

a third technology chamber, wherein the third technology chamber is located on the shoulder strap and positioned at a location proximate to the lower portion of the body, or proximate to the upper portion of the body; or proximate to a mid-point between the lower portion of the body and the upper portion of the body; and the third technology chamber is located on the inner portion.

12. The bag with integrated technology chamber for housing and screening a technology tank and attachments of claim 8, wherein:

the shoulder strap length is at least twice as long as the shoulder strap width;

the first technology chamber is located on the inner portion; and the first technology chamber is located on a portion of the shoulder strap proximate to the lower portion of the body or proximate to the upper portion of the body.

13. The bag with integrated technology chamber for housing and screening a technology tank and attachments of claim 8, wherein the fluid is a vaporous gas.

14. A bag with integrated technology chamber for housing a technology tank, the bag comprising:

a body comprising a compartment; and a shoulder strap connected to an upper portion of the body and a lower portion of the body, the shoulder strap comprising:

a first technology chamber, wherein:

the first technology chamber is sized to hold a first technology tank; and the first technology tank supplies a fluid, a first conduit internal to the shoulder strap, and a first portal to the first technology chamber, wherein:

the first portal is sized to pass a first tube from inside the shoulder strap to outside the shoulder strap;

the first portal is reinforced;

the first portal is connected to the first conduit; and the first conduit is connected to the first technology chamber.

15. The bag with integrated technology chamber for housing a technology tank claim 14, further comprising:

a second technology chamber located in the body, comprising:

a second technology tank, wherein the second technology tank supplies a liquid;

a second conduit;

a second portal, wherein:

the second portal is connected to the second conduit;

the second portal is sized to pass a second tube from inside the second technology chamber to the second conduit; and the second portal is reinforced.

16. The bag with integrated technology chamber for housing a technology tank of claim 14, wherein the first technology chamber includes a closure comprising a zipper, a hook and loop fastener, a snap, and/or a button.

17. The bag with integrated technology chamber for housing a technology tank of claim 14, further comprising:

the shoulder strap having a long edge; and a holding band, the holding band configured to hold the first tube in place on an exterior portion of the shoulder strap, wherein the holding band is positioned perpendicular to the long edge.

18. The bag with integrated technology chamber for housing a technology tank of claim 14, the shoulder strap further comprising:

a third technology chamber, wherein the third technology chamber is located on the shoulder strap and positioned at a location proximate to the lower portion of the body, or proximate to the upper portion of the body; or proximate to a mid-point between the lower portion of the body and the upper portion of the body; and the third technology chamber is sized to store a mouthpiece end of the tube.

19. The bag with integrated technology chamber for housing a technology tank of claim 14, wherein the fluid is a vaporous gas.

* * * * *